US008563885B2

(12) United States Patent
Tabib-Azar

(10) Patent No.: US 8,563,885 B2
(45) Date of Patent: Oct. 22, 2013

(54) CANTILEVERED BEAM NEMS SWITCH

(75) Inventor: Massood Tabib-Azar, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 356 days.

(21) Appl. No.: 12/943,575

(22) Filed: Nov. 10, 2010

(65) Prior Publication Data

US 2011/0168530 A1 Jul. 14, 2011

Related U.S. Application Data

(60) Provisional application No. 61/260,283, filed on Nov. 11, 2009.

(51) Int. Cl.
*H01H 57/00* (2006.01)

(52) U.S. Cl.
USPC ..... 200/181

(58) Field of Classification Search
USPC ..... 200/181; 257/213
IPC ..... H01H 1/0094
See application file for complete search history.

(56) References Cited

U.S. PATENT DOCUMENTS

| | | | | |
|---|---|---|---|---|
| 6,534,839 | B1 * | 3/2003 | Frazier et al. | 257/421 |
| 7,215,229 | B2 * | 5/2007 | Shen et al. | 335/78 |
| 2004/0240252 | A1 | 12/2004 | Pinkerton et al. | |
| 2008/0185271 | A1 | 8/2008 | Valenzuela et al. | |
| 2009/0243772 | A1 | 10/2009 | Bilhaut et al. | |
| 2009/0256594 | A1 * | 10/2009 | Zhu | 326/104 |
| 2010/0252403 | A1 | 10/2010 | Hays et al. | |

* cited by examiner

*Primary Examiner* — Vanessa Girardi
(74) *Attorney, Agent, or Firm* — Fulbright & Jaworski LLP

(57) ABSTRACT

Nanoelectromechanical devices use a cantilevered beam supported by a base. The cantilevered beam is constructed with a nanoscale gap (e.g., less than 10 nm) separating the cantilevered beam from an electrical structure. A low voltage (e.g., less than 2 volts) applied to the cantilevered beam can cause the beam to bend and make contact with the electrical structure. High switching speeds (e.g., less than 10 ns) can be provided. The electrical structure can be a second cantilevered beam or another structure.

14 Claims, 7 Drawing Sheets

CANTILEVERED BEAM NEMS SWITCH

This application claims the benefit of U.S. Provisional Patent Application Ser. No. 61/260,283 filed on Nov. 11, 2011, said application which is hereby incorporated by reference for all purposes.

This invention was made with government support under Award #NBCH1090003 awarded by the U.S. Department of the Interior. The government has certain rights in this invention.

FIELD

The present application relates to nanoelectromechanical devices. More particularly, the present application relates to switches, logic gates, and other devices than can be constructed using nanoelectromechanical devices.

BACKGROUND

Semiconductor transistors have been a mainstay of the electronics industry. Capable of being inexpensively mass produced, many integrated circuits comprise millions or billions of transistors. As the transistors are scaled down various effects (e.g., gate leakage current, etc.) inadvertently increase the standby power and reduce the ability of the scaled transistor to be completely switched making scaling below 10 nm gate length problematic. The off-to-on resistance ratio in transistors is relatively low and as the transistors scale down, their off resistance become low further reducing their off-to-on resistance ratio. Conduction through semiconductors also is affected as a function of temperature and radiation making silicon electronics, especially when scaled down to 10-30 nm gate lengths, severely problematic at elevated temperatures and in environments with cosmic and other (nuclear) radiation.

While various alternative types of devices other than semiconductor transistors have been under consideration, none have yet been able to replace the ubiquitous semiconductor transistor. Alternate device types can suffer limitations due to high switching voltages, low speed, large real-state area, difficulty in fabrication, and limited temperature operating ranges among other factors.

Mechanical switches have inherent radiation resistance, very high off-to-on resistance ratio and very low on resistance. Unfortunately, mechanical switches tend to be bulky and large, slow and unreliable with large turn on voltage and varying contact resistance.

SUMMARY

In some embodiments of the invention, shortcomings in the prior art can be addressed using a very unique switching structure that can provide a low turn on voltage, high speed and very small footprint.

In some embodiments of the present invention a nanoelectromechanical device comprises two cantilevered beams supported at fixed ends by a base. The beams can be separated by a gap of less than about 10 nanometers. The beams can include an electrically conductive material.

In some embodiments of the present invention a nanoelectromechanical device comprises a cantilevered beam disposed adjacent to a control structure and two electrically conductive structures. The beam, control structure, and electrically conductive structures can be supported by a base. The cantilevered beam can be separated from the control structure and electrically conductive structures by a gap of less than 10 nanometers. The cantilevered beam, electrically conductive structures, and control structure can each comprise an electrically conductive material.

In some embodiments of the present invention a method of making a nanoelectromechanical device is provided. The device can be constructed on a substrate. A first structural material can be deposited on the substrate and patterned to define terminals. A sacrificial layer can be formed on portions of the terminals, and the sacrificial layer has a thickness of less than about 10 nanometers. A second structural material can be deposited adjacent to the terminal and patterned to define a beam. The beam can be separated from the terminals by the sacrificial layer. The sacrificial layer can be removed to free the beam leaving the beam cantilevered and separated from the terminals by a gap of less than about 10 nanometers.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION

Figure 1:
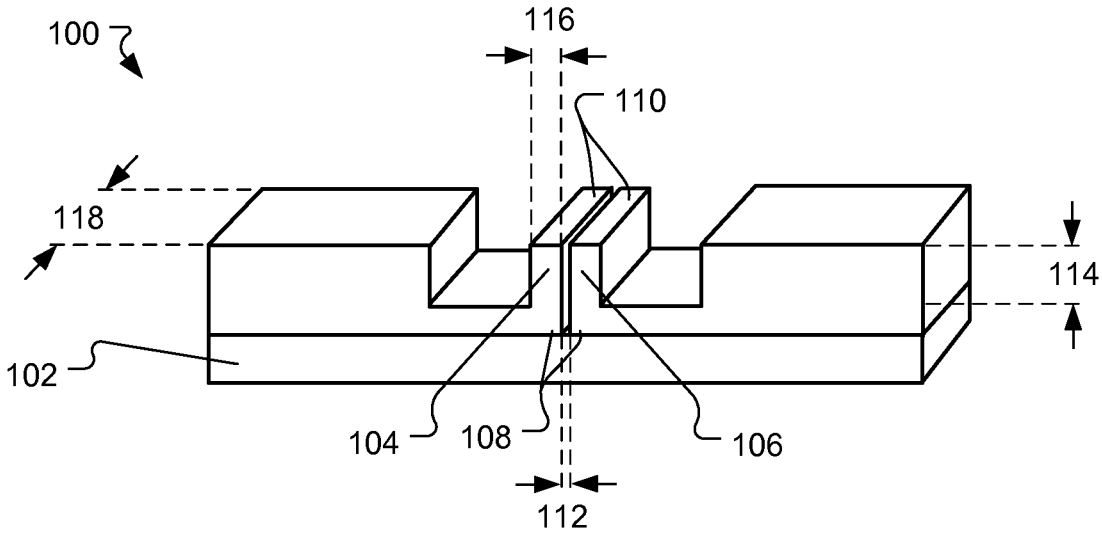
FIG. 1 is a side view illustration of a nanoelectromechanical system (NEMS) device in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to an item includes reference to one or more of the items.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items.

As used herein, the term "alternatively" refers to selection of one of two or more alternatives, and is not intended to limit the selection to only those listed alternatives unless the context clearly indicates otherwise.

One promising area for developing new device types are nano electromechanical systems (NEMS). Turning to FIG. 1, a NEMS device in the form a switch is illustrated in accordance with some embodiments of the present invention. The device, shown generally at 100, can be formed on a base 102. For example, the base can be a semiconductor substrate (e.g., silicon etc.), an insulating substrate (e.g., glass, quartz, ceramic, polymer, etc.), a layer of insulating material (e.g., silicon dioxide, sapphire, ceramic, glass etc.) deposited on a conductive or semiconductive layer (e.g., silicon, aluminum, etc.) or the like. Disposed on the base can be a pair of cantilevered beams comprising a first 104 cantilevered beam and a second 106 cantilevered beam. The cantilevered beams can have fixed ends 108 which are supported by the base and free ends 110. The cantilevered beams can extend vertically from the base, extending perpendicularly from the upper surface of the base and separated by a gap 112. For example, the gap can be less than about 10 nanometers (nm), less than about 5 nm, or less than about 2 nm. As a particular example, the gap can be approximately 1 nm. The cantilever beams can have a length 114 (height, e.g. in a direction perpendicular from the base) between about 400 nm and about 1000. The thickness 116 of the cantilever beams (e.g., in a direction perpendicular to the gap) can be between about 100 nm and about 500 nm. The width 118 of the cantilever beams (e.g., in a direction parallel to the gap) can be between about 100 nm and about 300 nm. The foregoing dimensions are examples only, and devices with one or more dimensions outside the foregoing ranges can also be used.

The cantilevered beams can be formed of or can include a conductive material. For example, the cantilevered beams can be formed of aluminum, tungsten, platinum, tungsten carbide, aluminum-nitrogen-oxygen, or combinations and alloys thereof. For example, tungsten carbide can be beneficial and providing for high temperature (e.g., greater than about 500 degrees C. operation).

Operation of the device 100 will now be described. A voltage applied across the cantilevered beams 104, 106 (e.g., a voltage potential of the first 104 cantilevered beam relative to the second 106 cantilevered beam) can produce electrostatic attraction between the beams. The cantilevered beams 104, 106 can be sufficiently thin that they are flexible enough so that the electrostatic attraction causes the beams to bend toward each other, displacing the free ends 110 of the beams. Thus, the device can move analogously to a tuning fork, with the cantilevered beams moving alternatively toward and away from each other, depending on the applied voltage.

Figure 2:
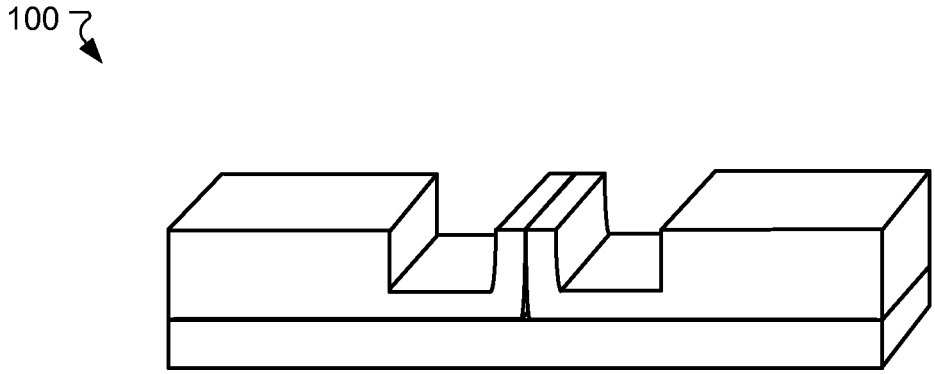
FIG. 2 is a side view illustration of the device of FIG. 1 with a voltage applied sufficient to cause the device to switch.

The device 100 can be operated as a switch. For example, the voltage can be sufficient to cause the beams 104, 106 to bend toward each other until they are touching. Deformation of the beams can be elastic, so that upon removal of the voltage, the beams can return to their previous parallel positions separated by the gap. For example, for devices 100 with dimensions within the above ranges, it has been discovered that a voltage between about 0.5 volts and about 2 volts can cause the beams 104, 106 to flex toward each other until they physically contact each other. For example, FIG. 2 illustrates the beams in an alternate, flexed position, cause by the application of a voltage potential. The beams 104, 106 can be constructed of materials such that the physical contact produces a substantially Ohmic connection between the beams. For example, the beams can each be formed from a metal (e.g., nickel, platinum, aluminum, combinations and alloys thereof, and combinations and alloys thereof further comprising oxygen, nitrogen, or both). For example, in some embodiments, the beam can comprise an alloy of aluminum which comprises nitrogen (about 4%) and oxygen (about 3-4%). As another example, in some embodiments, the beam can comprise platinum. Metal-metal contact generally provides an Ohmic contact. In some instances, oxide layers may be present on the one or both of the beam surfaces, which can result in some resistance to the contact. As another example, one beam can be formed from a metal, and the other beam can be formed from a semiconductor (e.g., n-doped silicon). Depending on the particular metal and semiconductor (and doping level) chosen, the metal-semiconductor contact can be substantially Ohmic (e.g., any Schottky voltage is sufficiently small to be negligible in the application in which the device is used). As a particular example, devices can provide a series resistance (when switched on, i.e. the beams are touching) of about 10 Ohms or less.

The turn-on voltage (voltage to cause the beams to touch) can be relatively low because both beams 104, 106 move. This can produce image effects which greatly reduce the turn-on voltage relative to devices using only a single moving part. For example, for metal-gap-metal and metal-gap-semiconductor devices with sufficiently high carrier concentration, turn-on voltages as low as 1 volt can be achieved with a 1 nm gap.

The device 100 is also capable of high frequency operation. In part, this is because of the higher frequency of the mechanical second resonant mode (~2f0). In this mode, the center of mass does not move and the two vertical cantilever beams are moving against each other as schematically shown in FIG. 2. In addition, there is a very low RC time constant associated with charging/discharging of the metallic interconnect transmission lines. Accordingly, the switching speed is primarily a function of the mechanical response of the moving parts (beams 104, 106) of the switch. Note also that damping by air modules is minimal, since the mean free path of air molecules is about 1 micrometer at 1 atmosphere and room temperature. Accordingly, switching speeds of less than 100 nanoseconds (ns) can be achieved. More particularly, devices with dimensions of the ranges shown above can provide switching speeds of less than about 10 nm, or more particularly switching speeds of about 1 ns (1 GHz).

Figure 3:
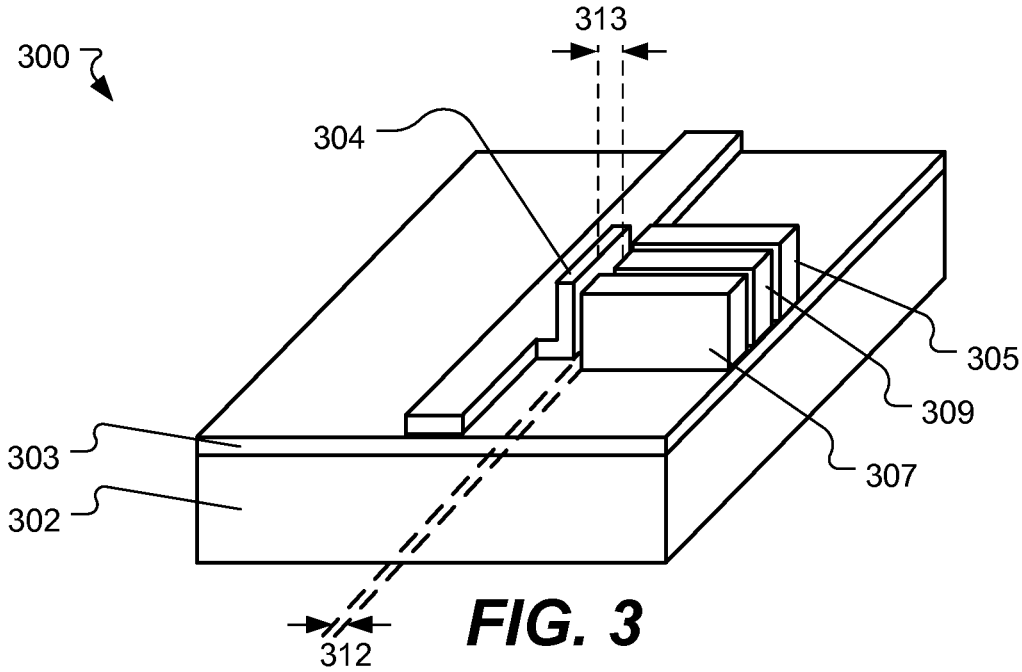
FIG. 3 is a perspective illustration of another NEMS device in accordance with some embodiments of the present invention.

In accordance with some embodiments of the invention, multi-terminal devices can be constructed. For example, FIG. 3 illustrates a NEMS device which can operate similarly to a field effect transistor. The device 300 can be constructed on a base 302, which can be like base 102. The base 302 can include an insulating layer 303. Disposed on the base can be a flexible cantilevered beam 304, which can be like beams 104, 106. The cantilevered beam 304 can be formed from, or can include, a conductive material. A first electrically conductive structure 305 and a second electrically conductive structure 307 can be supported by the base and positioned adjacent to the cantilevered beam 304. The first and second electrically conductive structures 305, 307 can be separated from the beam by a gap 312. While a first gap between the first electrically conductive structure 305 and a first portion of the cantilevered beam 304 is shown as being the same as a second gap between the second electrically conductive structure 307 and a second portion of the cantilevered beam, this is not essential, and the first and second gaps can be different.

A control structure 309 can be positioned between the first electrically conductive structure 305 and the second electrically conductive structure 307. The control structure 309 can be separated from the cantilevered beam 304 by a third gap 313. The third gap 313 can be, for example, less than about 10 nm, less than about 5 nm, or less than about 2 nm. As a particular example, the gap can be approximately 1 nm. The gap 312 between the first and second electrically conductive structures 305, 307 can be less than the third gap 313. The cantilever beam 304 can have similar dimensions as cantilevered beam 104. The cantilevered beam 304 can use similar materials as cantilevered beam 104.

Operation of the device 300 will now be described. A voltage can be applied across the cantilevered beam 304 relative to the control structure 309, which can produce electrostatic attraction between the cantilevered beam 304 and the control structure 309. This can cause the cantilevered beam 304 to flex towards the control structure 309 (and thus toward the first and second electrically conductive structures 305, 307). The cantilevered beam 304 can make contact with the first 305 and second 307 electrically conductive structures, thus completing an electrical connection between them. Because the third gap 313 is larger than the gap 312, contact between the cantilevered beam 304 and the control structure 309 can be avoided. In addition, if desired, an insulating material can be included on the control structure 309 to help avoid electrical contact between the control structure and the cantilevered beam 304. Accordingly, the device can be operated somewhat like a field effect transistor, with the control structure 309 acting like an (insulated) gate, and the first and second electrically conductive structures 305, 307 acting like the source and drain.

Figure 4:
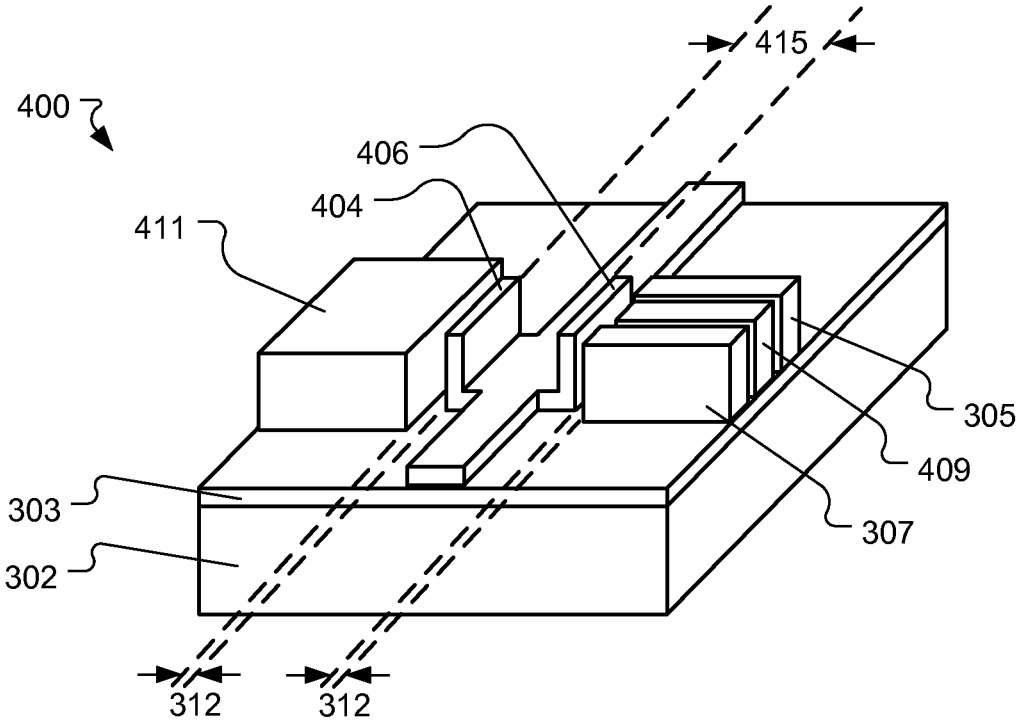
FIG. 4 is a perspective illustration of another NEMS device in accordance with some embodiments of the present invention.

The device 300 can be enhanced by using the tuning fork geometry similar to the switch device 100 of FIG. 1. Accordingly, as shown in FIG. 4, an PET-like NEMS device 400 is illustrated. The device 400 is similar to the device of FIG. 3, except that a pair of cantilevered beams 404, 406 is provided. The beams can be separated by gap 415. By including the pair of beams, and a corresponding pair of control structures 409, 411, similar benefits in switching speed and voltage are obtained as for the device 100 of FIG. 1. In particular, the cantilevered beams 404, 406 can move analogously to a tuning fork, with the cantilevered beams moving alternatively toward and away from each other, depending on the applied voltage. Accordingly, for devices 400 with dimensions in the ranges described above (e.g., fourth gap less than about 10 nm), a voltage between about 0.5 volts and about 2 volts can be sufficient to switch the device. Materials can be chosen in a similar manner as described above to provide Ohmic connection between the cantilevered beam 406 and the first and second conductive structures 305, 307.

The device can provide very low on resistance and very high off resistance. In part, the low on resistance can be achieved due to a metal-metal contact. To mitigate degradation of the on resistance, materials or covering of the contacts with oxide-resistance materials can be used. For example, while nickel was found to be subject to oxidation (and thus degradation in contact resistance over time), platinum was found to be excellent at maintaining a low contact resistance. An alloy of aluminum, oxygen (3-4%) and nitrogen (4%) was also found to provide excellent long term performance.

Low off resistance can be provided in part because of the use of an air gap. Leakage of less than 10 femto-Amperes has been observed. Off resistance can also be improved by limiting oxide formation at the surface (since oxide or nitride surfaces can introduce surface states with lower work function, increasing leakage). Surface treatments, such as carbide and graphene can help to increase the surface workfunction, helping to reduce tunneling leakage current while providing a low contact resistance. Further reduction in leakage current can be provided by undercutting as described further below.

The device 400 can be connected to operate in a manner similarly to complementary FETs. For example, we can define the first control structure 305 as the drain terminal and define the second control structure 307 as the source terminal. By electrically connecting either the source or the drain to the cantilevered beams 304, 306 (which can be defined as the gate terminal), behavior similar to an N-channel or P-channel metal-oxide-semiconductor (MOS) FET (MOSFET) can be obtained.

Figure 5:
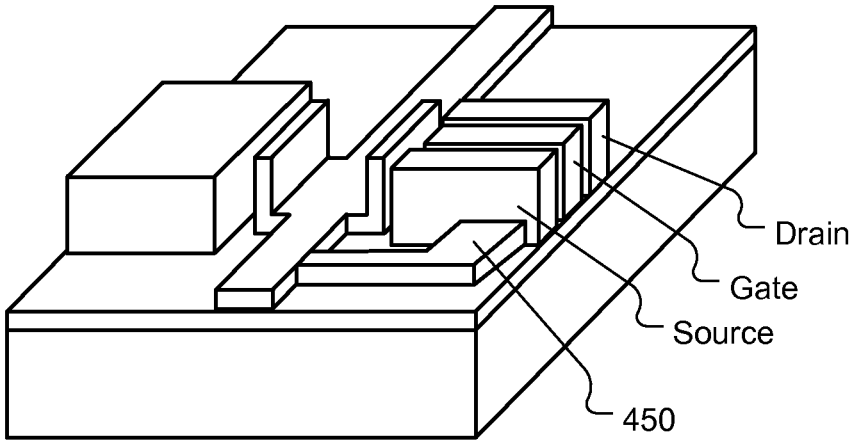
FIG. 5 is a perspective illustration of an N-type NEMS device in accordance with some embodiments of the present invention.
Figure 6:
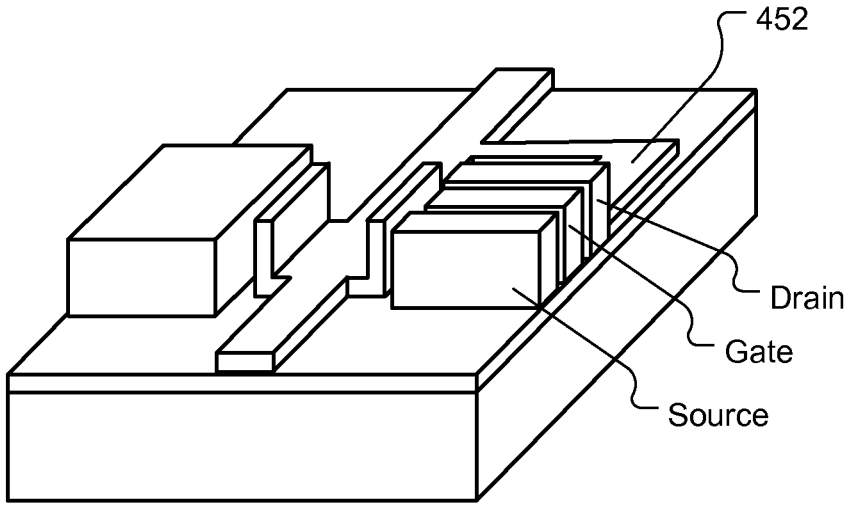
FIG. 6 is a perspective illustration of a P-type NEMS device in accordance with some embodiments of the present invention.
Figure 7:
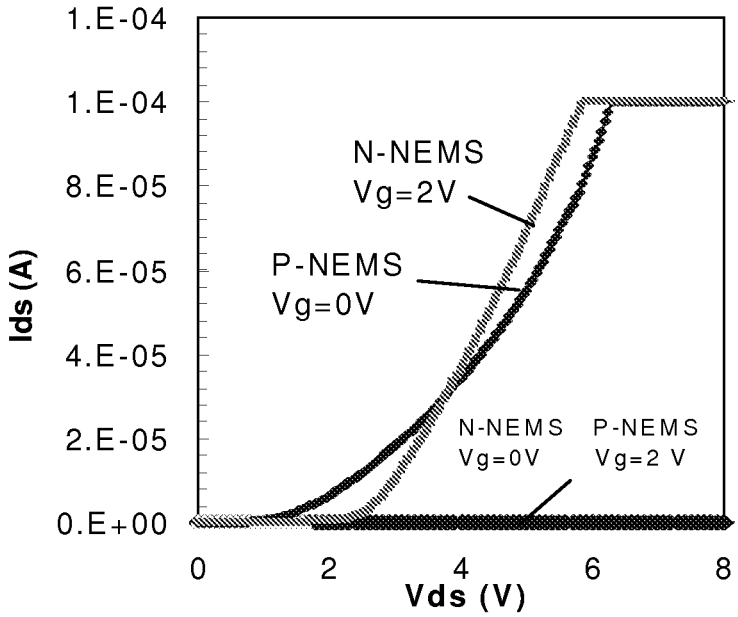
FIG. 7 is a graph showing the switching characteristics of the devices of FIGS. 5 and 6.

FIG. 5 illustrates an N-type device (referred to as an N-NEMS switch), where the cantilevered beam has an electrical connection 450 to the source terminal, and FIG. 6 illustrates a P-type device (referred to as a P-NEMS switch) where the cantilevered beam has an electrical connection 452 to the drain terminal. FIG. 7 illustrates the resulting complementary switching characteristics of the device.

Enhancement in the performance of complementary switches can also be obtained when using metal-gap-semiconductor configurations (e.g., where the gate is formed of a doped semiconductor material). For example, the gate can be N doped to improve performance in a P-NEMS, and conversely, the gate can be P doped to improve performance in an N-NEMS.

Figure 8:
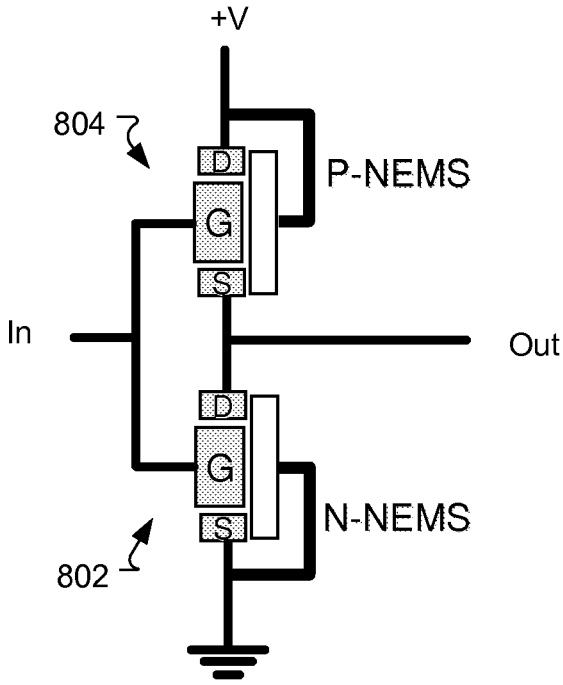
FIG. 8 is a schematic diagram of an inverter forming using an N-type and a P-type NEMS device in accordance with some embodiments of the present invention.

In some embodiments of the invention, pairs of N-NEMS and P-NEMS can be used to form complementary pairs in a manner similar to complementary MOS (CMOS) circuitry. Accordingly, NEMS switches can be combined to realize logic gates and similar functionality. For example, two devices can be combined to form an inverter as will now be explained. Turning to FIG. 8, a schematic illustration of an inverter formed using two NEMS switches is illustrated. A first device 804 is a P-NEMS device (e.g., like that shown in FIG. 6) and a second device 802 is an N-NEMS device (e.g., like that shown in FIG. 5). The gate terminals of the devices are tied together and provide the input. The drain of the N-NEMS device 802 is tied to the source of the P-NEMS device 804 and provides the output. The drain of the P-NEMS device 804 is tied to the positive supply rail, and the source of the N-NEMS device 802 is tied to the negative rail. When the input voltage In=0, the differential voltage between G and S of the P-NEMS is different than zero and in this case this device turns 'on'. The differential voltage between G and S for the N-NEMS is zero and this device turns 'off'. Thus the output voltage at Z is VDD or logic 1. When In=1, the P-NEMS turns 'off' and the N-NEMS turns 'on', the output voltage Z is equal to logic 0. Hence, a signal present at the input will produce an inverted version of the signal at the output.

More complex logic gates can be constructed in a similar manner, using various known CMOS logic gate architectures, but replacing p-channel MOSFETS with P-NEMS and replacing n-channel MOSFETS with N-NEMS. Accordingly, substituting NEMS devices for corresponding CMOS devices can allow for various logic gates such as NOT, XOR, NAND, etc. and other basic digital circuit building blocks such as D-latches, etc and even complex circuits such as processors to be constructed.

Integration of NEMS switches and CMOS transistors on a common substrate is possible because the devices have similar sizes and can be constructed using similar processes as discussed further below. Integration of CMOS and NEMS switches can provide various advantages in some embodiments of the invention. For example, NEMS switches can be viewed as voltage-controlled constant voltage sources. The NEMS switches can provide very high off resistance and very low on resistance, yet can be relatively slow at switching compared to CMOS devices. In contrast, CMOS devices can be viewed as voltage-controlled constant current sources. CMOS switches can present large quiescent power consumption even when off. CMOS can provide faster (picoseconds) switching compared to NEMS (nanosecond) switching speed. Accordingly, combining CMOS and NEMS devices in a circuit can provide for synergistic effects.

Figure 9:
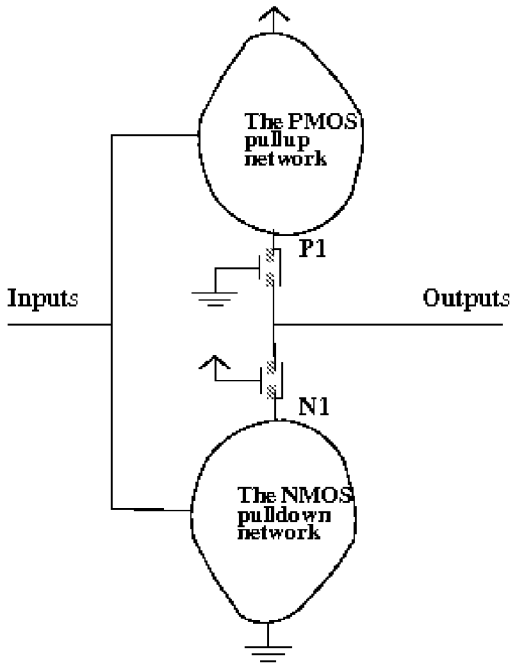
FIG. 9 is schematic of a CMOS circuit with a pair of complementary NEMS devices inserted into the output state in accordance with some embodiments of the present invention.

For example, FIG. 9 illustrates a modified CMOS circuit where a pair of complementary NEMS switches has been inserted into the output stage. Node P1 is connected to VDD when the PMOS network (P-network) is active (and disconnected otherwise) and node N1 is connected to GND when the NMOS network (N-network) is active (and disconnected otherwise). The N-network and the P-network are mutually exclusive and they are not active at the same time. This allows only either the PNEM or the NNEM switch to be 'on' which limits VDD to be connected to nodes in the P-network and GND to be connected to the N-network nodes. In other words, nodes in the N-network are only connected to '0', and nodes in the P-network are only connected to '1'. This can help to reduce switching and leakage current as compared to native CMOS. Benefits can thus include: minimizing i) the body effects, ii) the output capacitance, and iii) eliminating charging/discharging of internal node capacitances. In addition, the N-NEMS and P-NEMS switches can be locally connected reducing the wiring overhead. The gates of the NEMS switches are connected to either VDD or GND and the source/drains are connected to the outputs or to the pseudo output nodes (P1, N1)

Moreover, when the gate is in evaluation mode, both the N-NEMS and the P-NEMS switches are 'off' and the output is not connected to any power supply. When one of the CNEMS switches turns 'on' it indicates that the computation is completed. Exploiting the property that both CNEMS are off during evaluation enables this design style to be used to construct fast and more efficient asynchronous logic circuits. If desired, a completion signal, indicating that the gate is done computing, can be designed using the NEMS states. Using the completion signal, asynchronous circuits can therefore be constructed. These circuits do not have to deal with clock skew, can run at lower power (no toggles of clocks), and can therefore provide a number of benefits over synchronous logic (e.g., operating at average performance instead of worst case performance, easing need for global timing, and automatic adaption to physical properties).

Figure 10:
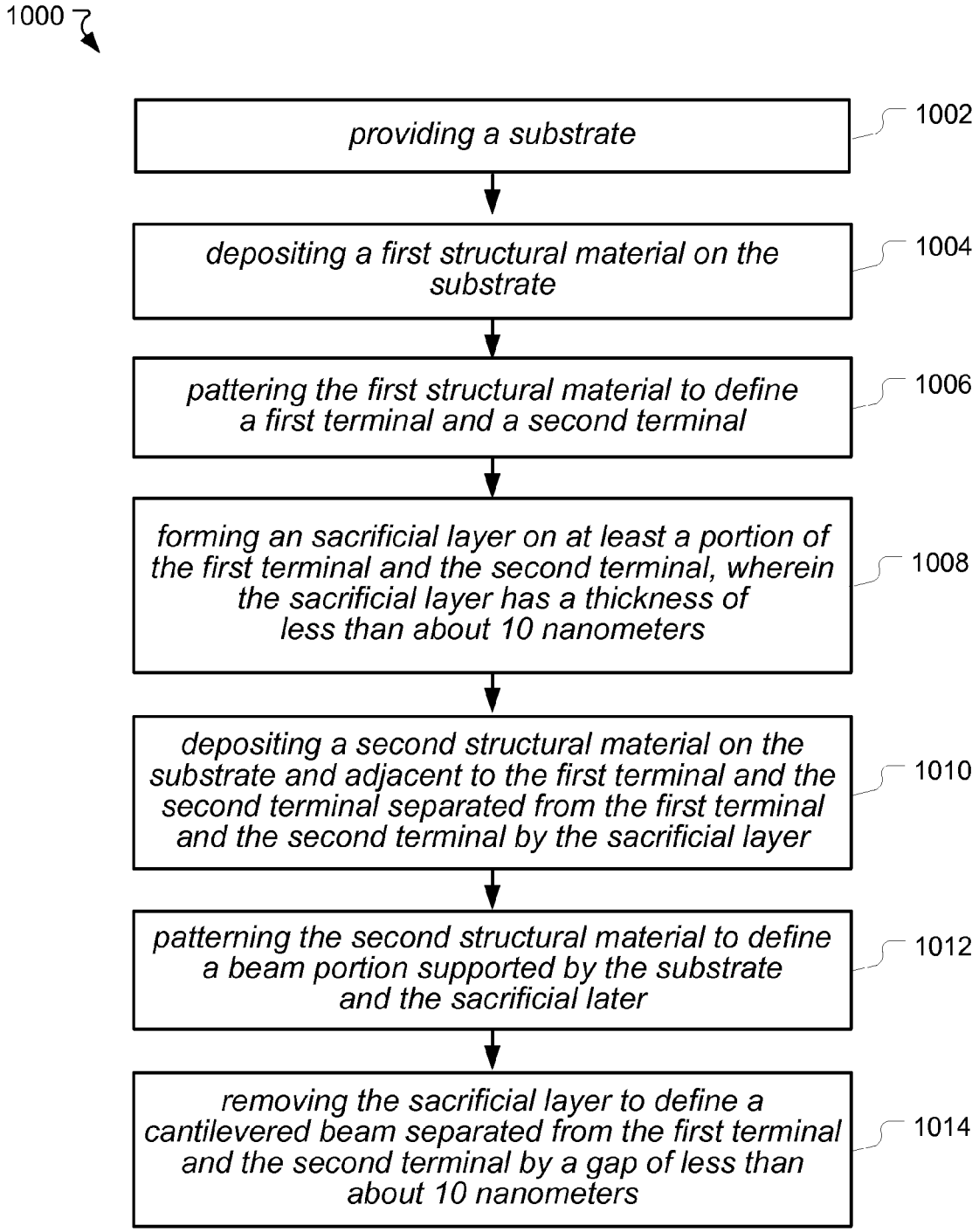
FIG. 10 is a flow chart of a method for making an NEMS device in accordance with some embodiments of the present invention.

Turning to FIG. 10, a method for making NEMS devices, such as for example devices described above, is illustrated. A device 1100 being constructed according to the method is illustrated in FIGS. 11A-11E.

Turning to FIG. 10, a first operation in the method can include providing 1002 a substrate. For example, the substrate can be an insulating material, an insulating layer disposed on a semiconductor material or conductive material, a semiconductor material, etc. as described above. For example, a silicon wafer can be used for fabrication of devices. An insulating layer (e.g., silicon dioxide) can be formed on the wafer. The silicon wafer can have various electronic devices (e.g. MOSFET transistors) fabricated thereon.

Figure 11A:
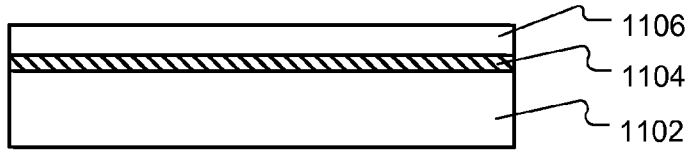
FIGS. 11A-11F are illustrations of a NEMS device in various stages of being fabricated in accordance with some embodiments of the present invention.

The method 1000 can include depositing 1002 a first structural material on the substrate. For example, the first structural material can be aluminum, nickel, platinum, tungsten, carbide, or combinations and alloys thereof, or other materials. Deposition can use, for example, physical vapor deposition, chemical vapor deposition, sputtering, or other techniques. FIG. 11A illustrates a substrate 1102 which has an insulating layer 1104. On top of the insulating layer 1104 the first structural material 1106 has been deposited.

Another operation in the method 1000 can be patterning 1006 the first structural material to define a first terminal and a second terminal. For example, the patterning can be performed by using photolithography, wherein a photosensitive mask layer is deposited, exposed, cured, and then developed to remove portions of the mask. Material can then be deposited or etched (e.g. through removed portions of the mask). Various alternative photolithographic processes can be used include negative resists, positive resists, deposition onto a mask, etching through a mask, and liftoff processes.

Figure 11B:
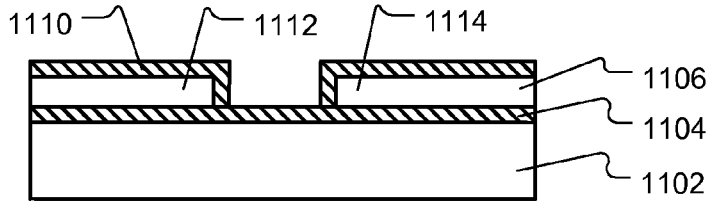

The method 1000 can include forming 1008 a sacrificial layer on at least a portion of the first terminal and the second terminal. The sacrificial layer can have a thickness of less than about 10 nm. For example, the sacrificial layer can be formed by dry oxide formation. As another example, the sacrificial layer can be formed using a self assembled monolayers such as dodecanethiol. FIG. 11B illustrates the substrate 1102 where the first structural material 1106 has been patterned to define a first terminal 1112 and a second terminal 1114. A sacrificial layer 1110 has been deposited onto the patterned first structural material.

Figure 11C:
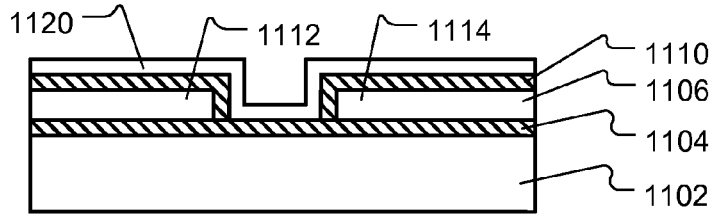
Figure 11D:
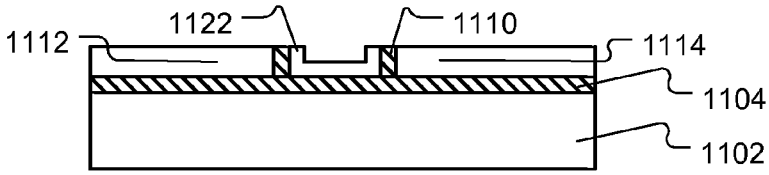

Another operation in the method 1000 can include depositing 1010 a second structural material on the substrate and adjacent to the first terminal and the second terminal separated from the first terminal and the second terminal by the sacrificial layer. For example, FIG. 11C illustrates the second structural material 1120 deposited onto the sacrificial layer 1110, hence placing it adjacent to the first terminal 1112 and the second terminal 1114. In another operation, the second structural material can be patterned 1012 to define a beam portion. For example, FIG. 11D illustrates the device after patterning the second structural material to define the beam(s) 1122. If desired, a chemical-mechanical planarization can be performed after any or all of the operations of: depositing the first structural material, depositing the second structural material, and forming the scarification layer.

Figure 11E:
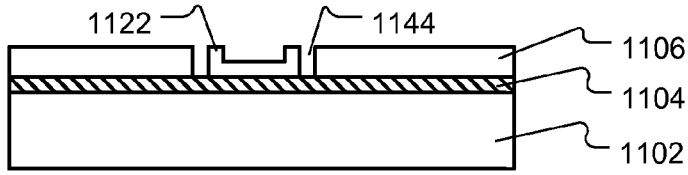

Finally, the method 1000 can include removing 1014 the sacrificial layer to release the beam thereby providing a cantilevered beam separated from the first terminal and the second terminal by a gap of less than about 10 nm. For example, FIG. 11E illustrates the device 1000 after removal of the sacrificial layer, thus defining a gap 1130 between the beam and the first terminal 1112 and second terminal 1114.

Figure 11F:
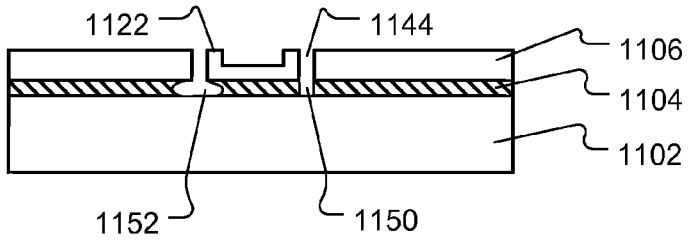

To reduce leakage currents, portions of the insulating layer 1104 can be removed between the terminals and the beam as shown in FIG. 11F. For example, portions 1150 between the cantilevered beam and the terminals can be removed. If desired, undercutting of the beam and terminals can also be performed, removing portions 1152 underneath (supporting) portions of the beam and terminals. Removal can be performed, for example, by wet etching.

Figure 12:
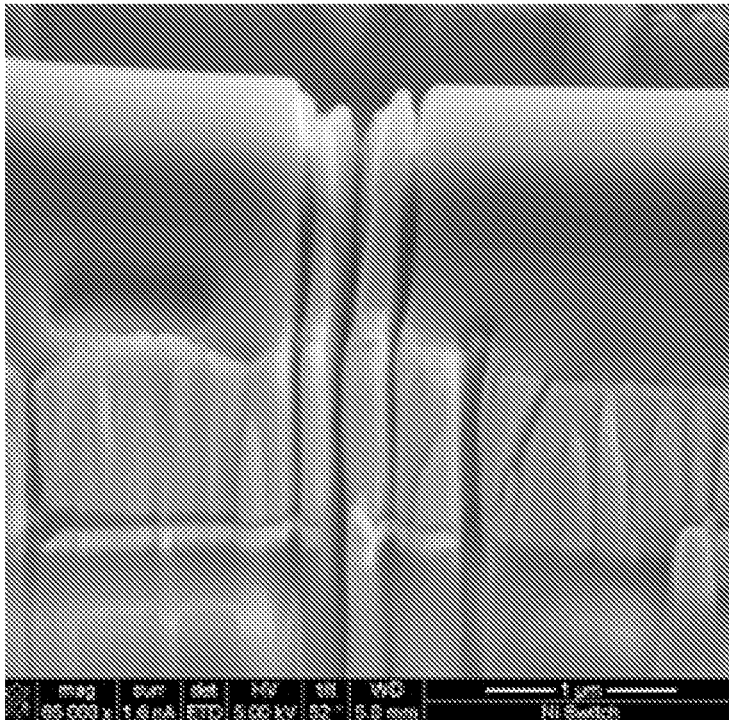
FIG. 12 is an electron microscope picture of a NEMS device in accordance with some embodiments of the present invention.

FIG. 12 provides an electron microscope picture of NEMS device having a gap of approximately 1 nm which was fabricated using a process similar to that of FIG. 10.

It will be appreciated that the forgoing fabrication steps and similar to and compatible with fabrication operations used to form semiconductor devices. Accordingly, NEMS devices can be constructed at the same time as portions (e.g., metallization layers) of a conventional semiconductor device. As another example, NEMS devices can be constructed on top of completed semiconductor devices (e.g., on top of an insulating layer). Interconnection of the NEMS devices and semiconductor devices can be performed using metallization interconnection layers (which can, for example, be formed as part of depositing the first structural material, the second structural material, or both.

In some embodiments of the invention, devices can be capable of operating for extended periods of time (e.g., greater than 1 hour) at elevated temperatures (e.g., above 600 degrees C.). In part this can be possible by avoiding the need for semiconductor materials which can rapidly form defects and degrade at high temperatures. For example, using an all-metal structure (e.g., cantilevered beam and terminals can be formed using platinum, aluminum alloy, tungsten-carbide, and either uncoated or coated with graphene) which provides high stability at elevated temperatures.

As will now be apparent, some embodiments of the invention can provide several advantages. NEMS switches using the disclosed techniques can provide operation at relatively low voltages (e.g., less than 2 volts) while providing low on resistance (e.g., less than 10 Ohms) to enable high currents. Accordingly, the NEMS switches can, for example, be used for power switching (e.g., for power conservation in battery operated equipment). The NEMS switches can also provide for low leakage, providing significantly lower leakage than similarly sized CMOS devices. Because the NEMS switches can be implemented using similar manufacturing processes as for CMOS devices, NEMS switches can be integrated with CMOS devices on the same substrate. Accordingly, CMOS devices can include NEMS switches, for example, to reduce power consumption. As another example, CNEMS switches can replace the N- and P-MOS FETs in logic gates and complex digital circuits, allowing for similar functionality with reduced power consumption. Operation at high temperatures that are not currently practical with semiconductor devices (e.g., greater than 600 degrees C.) can be provided.

While several illustrative examples and applications have been described, many other examples and applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts of the invention as set forth in the claims.

What is claimed is:

1. A nano electromechanical device comprising:

a base;

a first cantilevered beam comprising a fixed end supported by the base and comprising a free end, the first cantilevered beam comprising an electrically conductive material;

a second cantilevered beam comprising a fixed end supported by the base and comprising a free end, the second cantilevered beam comprising an electrically conductive material, wherein the second cantilevered beam extends substantially parallel to the first cantilevered beam and is separated from the first cantilevered beam by a gap of less than 10 nanometers, wherein an applied voltage differential of between about 0.5 volt and about 2 volts applied to the first cantilevered beam relative to the second cantilevered beam produces electrostatic attraction between the first and second cantilevered beams to cause the first and second cantilevered beams to bend displacing of their respective free ends so that the first and second cantilevered beams physically contact each other.

2. The device of claim 1, wherein the physical contact produces a substantially Ohmic connection between the first cantilevered beam and the second cantilevered beam, and the connection has a resistance of less than 10 Ohms.

3. The device of claim 1, wherein removal of the applied voltage differential causes the first cantilevered beam and the second cantilevered beam to return to substantially parallel relative positions relative to each other separated by the gap.

4. The device of claim 1, wherein the device transitions between an open state and a closed state in less than 10 ns.

5. The device of claim 1, wherein the electrically conductive material comprises aluminum, platinum, tungsten, tungsten carbide, aluminum-nitrogen-oxygen, or combinations and alloys thereof.

6. The device of claim 1, wherein the device is integrated with a complementary metal oxide semiconductor logic circuit disposed on the base.

7. A nano electromechanical device comprising:

a base;

a first cantilevered beam comprising a fixed end supported by the base and comprising a free end, the first cantilevered beam comprising an electrically conductive material;

a second cantilevered beam comprising a fixed end supported by the base and comprising a free end, the second cantilevered beam comprising an electrically conductive material, wherein the second cantilevered beam extends substantially parallel to the first cantilevered beam and is separated from the first cantilevered beam by a gap of less than about 10 nanometers, the cantilevered beams each have a length between about 400 nanometers and about 1000 nanometers;

the cantilevered beams each have a thickness in a direction perpendicular to the gap between about 100 nanometers and about 500 nanometers; and the cantilevered beam each have a width in a direction parallel to the gap between about 100 nanometers and about 300 nanometers.

8. The device of claim 7, wherein the first and second cantilevered beams each extend substantially perpendicularly from the base.

9. A nano electromechanical device comprising:

a base;

a first flexible cantilevered beam supported by the base and comprising an electrically conductive material;

a first electrically conductive structure supported by the base and positioned adjacent to a first portion of the first cantilevered beam and separated by a first gap;

a second electrically conductive structure supported by the base and positioned adjacent to a second portion of the first cantilevered beam and separated by a second gap;

a first control structure supported by the base and positioned adjacent to the first cantilevered beam between the first portion and the second portion and separated from the first cantilevered beam by a third gap, wherein the third gap is less than 10 nanometers and the first gap and second gap are each less than the third gap.

10. The device of claim 9, further comprising a second flexible cantilevered beam supported by the base and adjacent to the first cantilevered beam and separated by a fourth gap, wherein the fourth gap is less than 10 nanometers, and wherein the first flexible cantilevered beam and the second flexible cantilevered beam are electrically connected one to another.

11. The device of claim 9, wherein an applied voltage differential of between about 0.5 volt and 2 volts applied to the control structure relative to the cantilevered beam produces electrostatic attraction between the control structure and the cantilevered beam to cause the cantilevered beam to flex toward the control structure and make substantially Ohmic contact with each of the first electrically conductive structure and the second electrically conductive structure.

12. The device of claim 9, wherein:

the cantilevered beam has a length between 400 nanometers and 1000 nanometers;

the cantilevered beam has a thickness in a direction perpendicular to the gap between 100 nanometers and 500 nanometers; and the cantilevered beam has a width in a direction parallel to the gap between about 100 nanometers and 300 nanometers.

13. The device of claim 9, wherein the electrically conductive material comprises aluminum, platinum, tungsten, tungsten carbide, aluminum-nitrogen-oxygen, or combinations and alloys thereof.

14. The device of claim 9, further comprising:

a second flexible cantilevered beam supported by the base and comprising an electrically conductive material;

a third electrically conductive structure supported by the base and positioned adjacent to a first portion of the second cantilevered beam and separated by a fourth gap;

a fourth electrically conductive structure supported by the base and positioned adjacent to a second portion of the second cantilevered beam and separated by a fifth gap;

a second control structure supported by the base and positioned adjacent to the second cantilevered beam between the first portion and the second portion and separated from the cantilevered beam by a sixth gap, wherein the sixth gap is less than 10 nanometers and the fourth gap and fifth gap are each less than the third gap; and an input electrical interconnection electrically connecting the first control structure to the second control structure;

an output electrical interconnection electrically connecting the second electrically conductive structure to the third electrically conductive structure; and wherein a signal provided to the input electrical interconnection produces an inverted version of the signal at the output electrical interconnection when the first electrically conductive structure is tied to a positive voltage and the fourth electrically conductive structure is tied to a negative voltage.

* * * * *

UNITED STATES PATENT AND TRADEMARK OFFICE

CERTIFICATE OF CORRECTION

PATENT NO. : 8,563,885 B2
APPLICATION NO. : 12/943575
DATED : October 22, 2013
INVENTOR(S) : Massood Tabib-Azar It is certified that error appears in the above-identified patent and that said Letters Patent is hereby corrected as shown below:

In the Specification:

At column 1, line numbers 7-10, delete the following paragraph:

> "This invention was made with government support under Award #NBCH1090003 awarded by the U.S. Department of the Interior. The government has certain rights in this invention."

and insert the following paragraph:

> --This invention was made with government support under NBCH1090003 awarded by the Department of Defense – Advanced Research Projects Agency. The government has certain rights in the invention.--

Signed and Sealed this
Seventeenth Day of May, 2016

Michelle K. Lee

Michelle K. Lee
*Director of the United States Patent and Trademark Office*